US005581827A

United States Patent [19]

Fong et al.

[11] Patent Number: 5,581,827

[45] Date of Patent: Dec. 10, 1996

[54] FOLDABLE PLAYYARD

[75] Inventors: H. G. Robert Fong, Los Angeles; Denny T. H. Tsai, Chino Hills, both of Calif.

[73] Assignee: Baby Trend, Inc., Pomona, Calif.

[21] Appl. No.: 291,625

[22] Filed: Aug. 17, 1994

[51] Int. Cl.[6] ..... A47D 7/00

[52] U.S. Cl. ..... 5/98.1; 5/99.1

[58] Field of Search ..... 5/98.1, 98.2, 98.3, 5/99.1, 120, 121, 122, 123, 124, 125, 126, 127, 128, 129, 130

[56] References Cited

U.S. PATENT DOCUMENTS

| | | | |
|---|---|---|---|
| 2,014,904 | 9/1935 | Martin | 5/99.1 |
| 2,369,885 | 2/1945 | Dobrenen | 5/98.2 |
| 2,486,054 | 10/1949 | Morse . | |
| 2,589,805 | 3/1952 | Hausner, Jr. | 5/99.1 |
| 2,698,443 | 1/1955 | Ralick . | |
| 2,784,420 | 3/1957 | Moltane . | |
| 2,816,295 | 12/1957 | Landry . | |
| 3,018,493 | 1/1962 | Wittbrodt . | |
| 4,070,716 | 1/1978 | Satt et al. . | |
| 4,202,065 | 5/1980 | Sullivan . | |
| 4,376,318 | 3/1983 | Cirillo . | |
| 4,483,026 | 11/1984 | Kassai . | |
| 4,538,309 | 9/1985 | Gunter . | |
| 4,614,454 | 9/1986 | Kassi . | |
| 4,692,953 | 9/1987 | Fetters . | |
| 4,710,049 | 12/1987 | Chang . | |
| 4,739,527 | 4/1988 | Kohus et al. . | |
| 4,750,223 | 6/1988 | D'Arcy et al. . | |
| 4,765,004 | 8/1988 | Kessel . | |
| 4,811,437 | 3/1989 | Dillner et al. . | |
| 4,819,285 | 4/1989 | Fetters . | |
| 4,837,875 | 6/1989 | Shamie et al. . | |
| 4,934,025 | 6/1990 | Mariol . | |
| 4,985,948 | 1/1991 | Mariol . | |
| 5,241,716 | 9/1993 | Kohus . | |
| 5,339,470 | 8/1994 | Shamie | 5/98.1 |

*Primary Examiner*—Steven N. Meyers
*Assistant Examiner*—Robert G. Santos
*Attorney, Agent, or Firm*—Frost & Jacobs, Inc.

[57] ABSTRACT

In a foldable playyard an improved floor assembly avoids the accidental folding of the playyard with the child in the playyard. A fabric floor assembly comprising three separate panels, two of which are fully secured peripherally to the frame assembly for a sturdier bottom/floor is disclosed. Also the two bottom layers are purposely separated from each other so as to create an air-gap therebetween to serve as a natural "shock-absorber" for a child jumping up and down in the playyard. One layer of the double layer fabric floor assembly is connected to all the vertical panels and the second layer is attached to the lower horizontal supports.

5 Claims, 2 Drawing Sheets

FOLDABLE PLAYYARD

FIELD OF THE INVENTION

This invention relates generally to a foldable playyard and more particularly, to an improved foldable playyard with upper and lower rectangular support rails, corner connecting members at the corners of the lower rectangular support rails, side portions and an improved fully supported fabric floor, the playyard being foldable into a compact unit ready for convenient transportation and storing.

BACKGROUND OF THE INVENTION

Playyards, also called play pens, have been available for several years. Foldable playyards of the knock-down variety are also common. The following prior art documents are illustrative of the prior art considered relevant to the present invention.

U.S. Pat. No. 5,241,716 to Kohus (hereinafter referred to as "the Kohus patent") discloses a portable playyard comprising a frame assembly and a fabric enclosure. The frame assembly comprises lower and upper corner rail connecting members, vertical corner rails, a pair of pivotally connected floor support rails between each set of lower corner rail connecting members, and a pair of pivotally connected upper side rail members between each set of upper corner rail connecting members. A frame lock is mounted on ends of the upper side rails to hold the side rails in a straight in-line mode or, upon rotation, allows the side rails to pivot downwardly. Meshing hinge gears in each frame lock form a single pivot point for the two upper side rail ends held by the frame lock. The frame assembly is folded to a compact unit by initially rotating the frame locks and then folding the assembly. The frame assembly is capable of holding the fabric enclosure so as to provide a playyard. The Kohus patent is incorporated by reference herein.

U.S. Pat. No. 4,985,948 to Mariol (hereinafter referred to as "the Mariol patent") discloses a portable, foldable playyard comprising Y-shaped lower corner rail connecting members 28; upper rail connecting members 54; vertical corner support rails 18; pivotally connected floor side rails 22 and pivotally connected upper side rails. The sides of the playyard and the bottom of the frame are covered with a fabric assembly 50. The fabric assemble 50 is of an essentially box-like construction without a top. Four vertical panels are connected to a single horizontal panel. The vertical panels are each coupled to the floor side rails 22 and then stitched to the single horizontal panel. Thus, the floor side rails are always being pulled upwardly because of their direct connection to the vertical panels. In the worst case scenario, this upward pressure could cause the crib of the 948 patent to fold with the child in the crib. As stated in the specification of the Mariol patent itself, "[t]his configuration facilitates the raising of the hinges of the lower support upon lifting of [a] tab . . . which is stitched to the center of the upper surface of [horizontal] panel 114." Also, the folding of the vertical panels around the rails 22 and subsequent stitching of the vertical panels to the horizontal panel is an involved, complicated and expensive step. Moreover, the Mariol playyard does not include a double fabric layer at the bottom for increased support, sturdiness and stability. The Mariol patent is incorporated by reference herein.

U.S. Pat. No. 4,934,025 also to Mariol describes a foldable playyard comprising a central hub, pivotally attached floor support legs, and upper side rails which are pivotally attached together in a midpoint and to upper shoulder brackets.

U.S. Pat. No. 4,811,437 to Dillner et al. discloses a foldable playyard comprising an upper rectangular form cooperating with vertical corner rails and a lower support formed of a spider-like array of rails positionable in a horizontal plane. The lower support includes a central hub for raising the lower rails upwardly while collapsing the rails of the upper support downwardly to fold the playyard. A fabric assembly is also included with four vertical side panels and a lower horizontal floor panel. The lower horizontal floor panel is held in position solely by the vertical panels and a rigid removable floor.

U.S. Pat. No. 2,698,443 to Ralick discloses a foldable playyard with upper and lower horizontal rails in a rectangular configuration along with vertical corner rails. Ralick utilizes two separate fabric webs in a U-shaped configuration. The two webs are at right angles to each other and form a double fabric at the bottom. However, neither of Ralick's bottom fabric layers are attached to the lower horizontal rails. Also, neither of Ralick's bottom fabric layers are joined to all the vertical fabric panels. Furthermore, Ralick's two bottom fabric layers are not separated by an air-gap, being immediately adjacent to and touching each other.

U.S. Pat. No. 2,486,054 to Morse discloses a foldable crib with upper and lower rectangular supports with independent side panels and a completely separate lower horizontal floor panel. However, in Morse, hinges of the frame are exposed, thereby creating a safety hazard for a child within the crib or a parent raising or lowering the crib. Additionally, replacing damaged or worn fabric panels would be expensive and involved.

While the prior art discloses various features in foldable playyards, none discloses a lower horizontal support structure which avoids the accidental folding of the playyard with the child in the playyard. Further, none disclose a fabric floor assembly comprising three separate panels, two of which are fully secured peripherally to the frame assembly for a sturdier bottom/floor. Moreover, none of the prior art documents disclose a double fabric layer at the bottom of the playyard, with the two bottom layers purposely separated from each other so as to create an air-gap therebetween to serve as a natural "shock-absorber" for a child jumping up and down in the playyard. Also, none of the prior art references discloses a double layer fabric floor assembly, with one layer connected to all the vertical panels and the second layer attached to the lower horizontal supports. All of the above features missing from the prior art, are incorporated in the playyard of the present invention.

SUMMARY OF THE INVENTION

It is a primary object of this invention to provide a playyard for safe occupation by a child having an improved fabric floor assembly comprising two separate fabric panels which are fully secured peripherally to the frame assembly.

It is a further object of the present invention to provide an improved foldable playyard which greatly reduces the accidental folding of the playyard with the child in the playyard, by the provision of an improved fabric floor assembly.

In accordance with the present invention there is provided in a foldable playyard comprising an essentially rectangular upper support formed of four pair of rods each centrally coupled by a hinge; an essentially rectangular lower support formed of four pair of rods each centrally coupled by a hinge; four vertical rails interconnecting the corners of the upper and lower supports to retain the upper and lower supports in a box-like configuration with the rods of the upper and lower supports pivotally coupled to the vertical rails to allow for pivoting the rods of the upper support and lower support between horizontal orientations when the playyard is in an unfolded condition for operation and use and vertical orientations when the playyard is in a folded condition for storage; and a unitive fabric assembly comprising four vertically disposed panels each coupled to a pair of rods of the upper support and adjacent vertical tubes, the improvement comprising: a first lower horizontal panel stitched to the vertically disposed panels and forming a part of the unitary fabric assembly, said first panel not being coupled between the rods of the lower rectangular support; and a second lower horizontal panel coupled between the rods of the lower rectangular support but not forming a part of the unitary fabric assembly.

DETAILED DESCRIPTION OF THE INVENTION

The portable playyard 10 of this invention comprises a frame assembly 11 and a fabric enclosure 12. The following paragraphs describe in detail the components of a preferred embodiment of the playyard 10 of the present invention and its manner of use.

Figure 1:
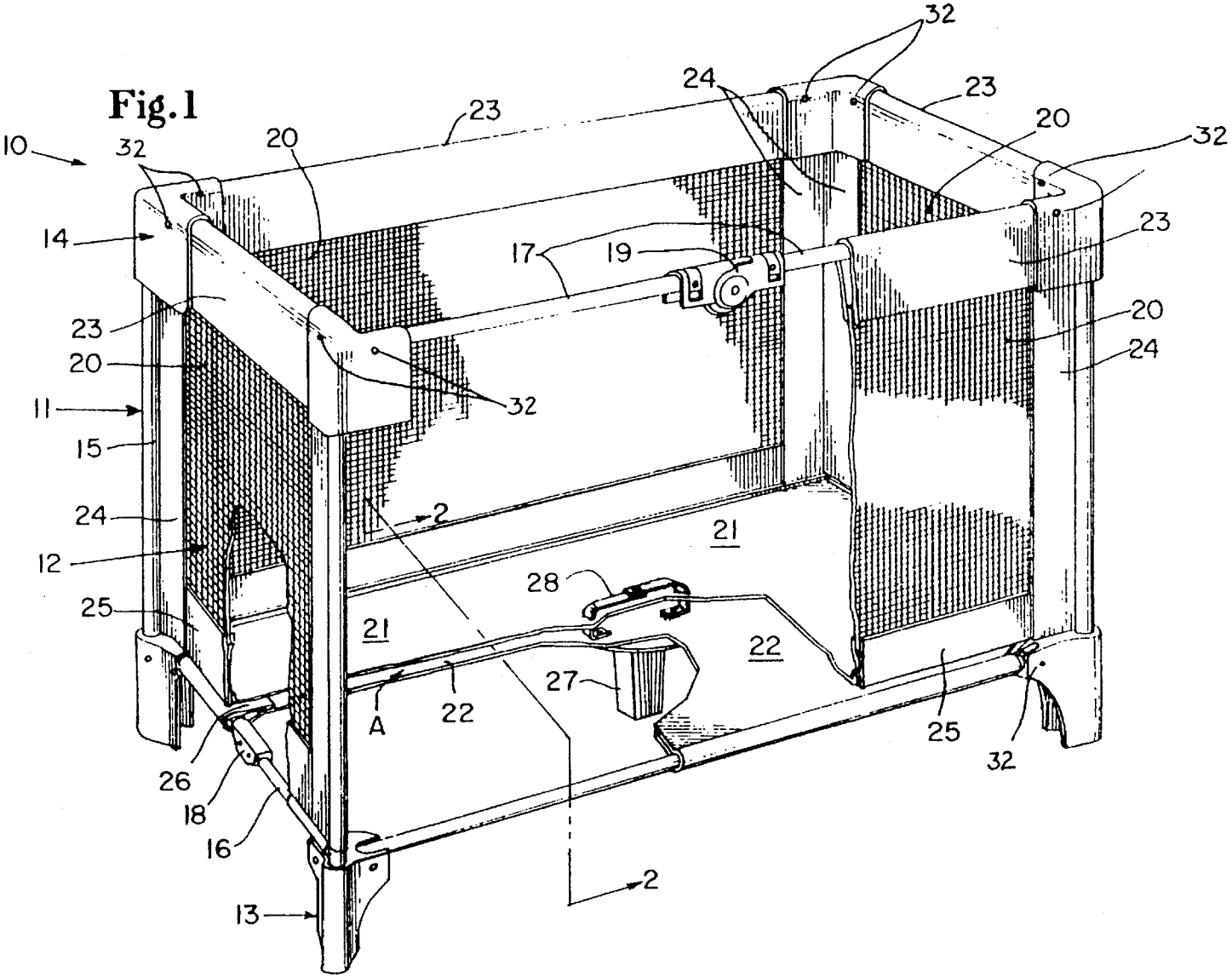
FIG. 1 is a perspective view of a foldable playyard in accordance with the present invention.
Figure 2:
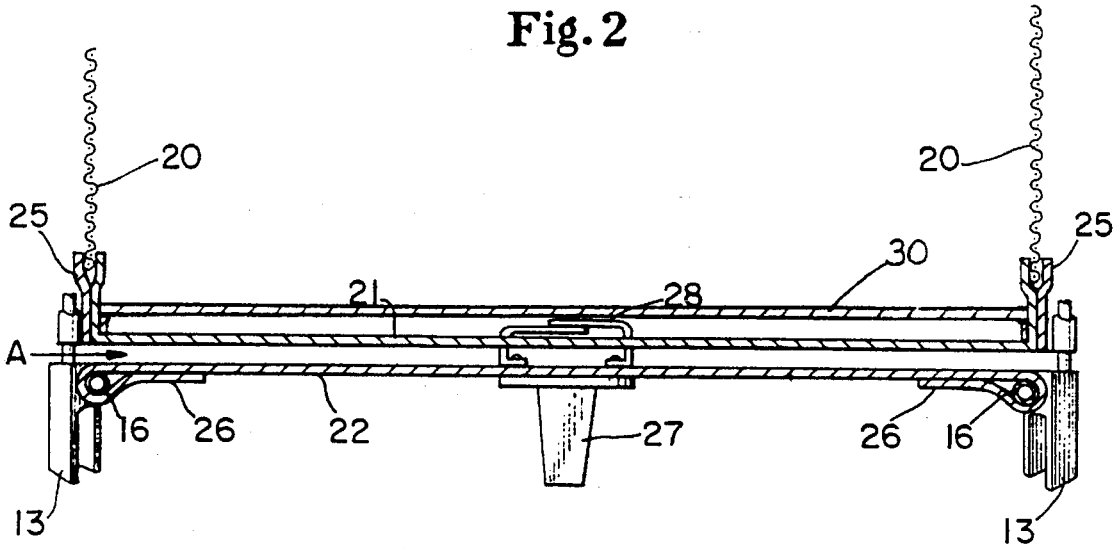
FIG. 2 is a sectional view of the rail and fabric panel assembly taken along lines 2—2 of FIG. 1.

With reference to FIG. 1 there is illustrated a playyard 10 of the invention wherein a frame assembly 11 is in the in-use position with a fabric enclosure 12 properly positioned on the assembly. The frame assembly 11 comprises lower corner rail connecting members 13, upper corner rail connecting members 14, vertical corner rails 15, pivotally connected floor support rails 16 and pivotally connected upper side rails 17. An intermediate pivot connecting member 18 pivotally holds ends of the floor support rails 16 in a manner which allows the rails 16 to pivot upwardly only. An intermediate frame lock 19 pivotally holds ends of the upper side rails 17. The frame lock 19 when properly oriented by manual rotation allows the side rails 17 to pivot downwardly. These individual components are further described below.

A pair of the floor support rails 16 extends between each adjacent set of lower corner rail connecting members 13. The two pairs of support rails 16 which are parallel to one another are the same approximate length. Pairs of end and side floor support rails 16 can be a different length depending on whether a square-shaped or rectangular-shaped playyard is desired. As mentioned before, one end of each floor support rail 16 is pivotally attached to a lower corner rail connecting member 13 by pivotally connecting member 32. The other end of each rail 16 is pivotally connected together by an intermediate hinged connecting member 18. The intermediate pivot connecting member 18 allows the floor support rails to pivot in one direction only, namely upwardly.

A pair of pivotally connected upper side rails 17 extends between adjacent upper corner rail connecting members 14. The lengths of each of these upper rails 17 is approximately the same as an underlying floor support rail 16. Each upper side rail 17 is pivotally connected on one end to the upper corner rail connecting member 14 by pivotally connecting member 32 and pivotally connected at the other end to the intermediate frame lock 19. The frame lock 19 is capable of locking each pair of upper side rails 17 in a straight line in-use configuration. Upon manual rotation of the frame lock 19 about its axis, the side rails 17 are released to cause them to pivot downwardly. As discussed in detail in the Kohus and Mariol patents, the frame locks 19 are constructed so as to allow the playyard to be erected or folded to a compact state, simply and quickly.

Rotation of the frame lock 19 in an appropriate fashion allows the upper side rails 17 to pivot downwardly both at the upper pivotally connecting member 32 of the corner rail connecting members and at the frame lock. This then allows the floor support rails 16 to pivot upwardly, both at the lower pivotally connecting member 32 of the corner rail connecting members 13 and at the intermediate rail connecting member 18. It should be apparent that the frame lock 19 is comprised of a minimum number of parts, most of which can be molded to exact dimensions with little concern for subsequent manufacturing variances. The components of the frame lock are also readily assembled. In use, the frame locks 19 help in ensuring that the frame assembly 11 of the playyard 10 does not accidentally collapse.

The lower and upper corner rail connecting members, pivot connecting members and frame locks can be molded from a rigid polymeric plastic material. The vertical corner rails, floor support rails and upper side rails can be made of a rigid, lightweight metal material. Other materials of construction can be used as will be readily apparent to a person skilled in the art.

Figure 3:
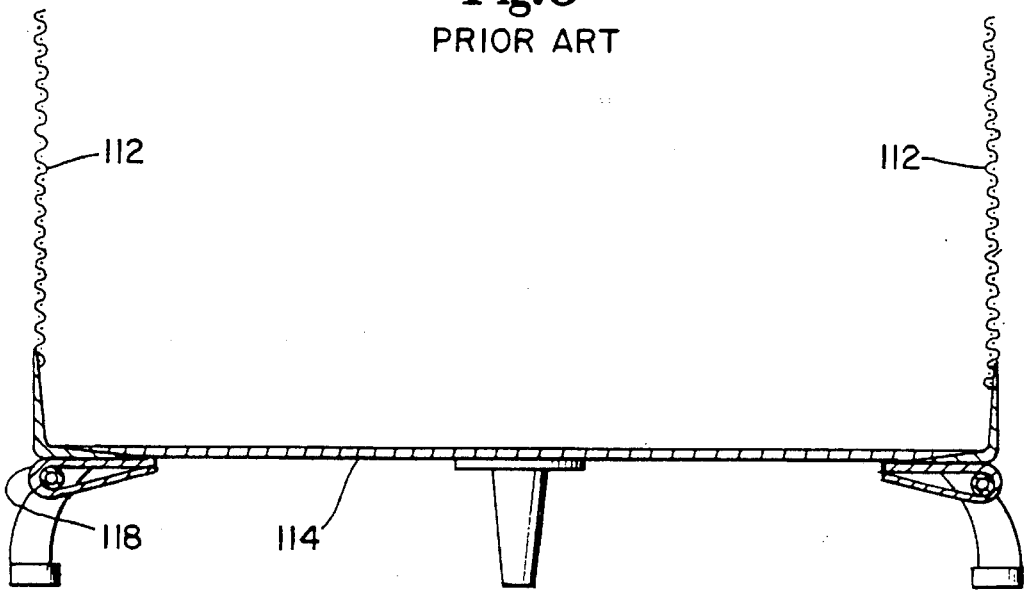
Fig. 3 PRIOR ART
FIG. 3 is a sectional view of the rail and fabric panel assembly of the prior art playyard of the Mariol patent, taken along lines analogous to lines 2—2 of FIG. 1 herein.

The flexible fabric enclosure 12 is of an essentially box-like construction without a top. It comprises four side panel portions 20 and two floor portions, upper floor portion 21 and lower floor portion 22. Unlike the single horizontal panel 114 of the Mariol playyard (shown as prior art in FIG. 3), which is supported by lower support 16 and is stitched to the bottom portions of the vertical side panels 112, only the upper floor portion 21 of the present invention is stitched to the lower portions of the four side panels 20. Upper floor portion 21 of the present invention is not supported by lower rails 16. Contrarily, lower floor portion 22 is in fact supported by lower rails 16 in the present invention. Four horizontal hems 26 receive the four lower rails 16 and are stitched to the adjacent horizontal edges of lower floor portion 22. However, again unlike the Mariol playyard, the lower floor portion 22 is not stitched to the bottom portions of the vertical side panels 20. Preferably, an air-gap "A" may be created between floor portions 21 and 22, to act as a natural "shock-absorber" as described above. If desired, side panel portions 20 may be provided with netting as shown in FIG. 1 so as to enhance ventilation and to allow the child to see and be seen. The double floor assembly 21 and 22, along with the frame lock 19, ensures that a child will not inadvertently collapse or disassemble the playyard 10.

An upper horizontal hem 23 is located along the upper peripheral edge of all four vertical portions 20 for receiving the upper rails 17. Four vertical hems 24 receive the four vertical rails 15 and are stitched to the adjacent vertical edges of vertical portions 20. Preferably, the upper horizontal hems 23 are lined inside with foam cushion sleeves to ensure the child cannot injure himself or herself by the rigid upper side rails 17. Unlike the parallel rectangular hem 118 in the periphery of the horizontal bottom panel 114 of the Mariol playyard, the four vertical portions 20 are directly stitched to the upper floor portion 21, without folding the vertical portions 20 around the lower support 16, as in the Mariol patent in FIG. 3 herein. In the preferred embodiment, a lower vertical hem 25 is located along the lower peripheral edge of all four vertical portions 20 for stitching to the upper floor portion 21.

The portions 20, 21 and 22 are fabricated of a sturdy fabric material for strength, cleanability and toxic safety. The upper corners and other areas of wear are preferably double ply. The vertical side panels 20 preferably include open mesh centrally stitched in location to allow visual communication between child and parent and for a better flow of air for child comfort.

A removable floor 30 may preferably be a part of the playyard 10 (corresponding to floor 60 of the Kohus playyard). A funnel 27 is stitched to the center of the lower floor portion 22 of the fabric support assembly 12 for providing support to such fabric as well as to the floor (if present). Around the periphery of the funnel 27, a loop 28 may be preferably stitched to the two points on the bottom of lower floor portion 22, then passed through lower floor portion 22, through upper floor portion 21, and then stitched together (to form a loop), above upper floor portion 21. If present, this loop 28 aids in lifting the fabric floors 21 and 22 of the playyard 10, during disassembly, as described below.

In operation, the playyard 10 of the present invention is easily assembled, erected and folded. When erected, the playyard 10 is maintained in a stable configuration with the vertical corner rails upstanding. The corner rails are spread by the floor support rails and upper side rails. The frame locks 19 steady the upper side rails in a sturdy horizontal position and along with the double fabric floor assembly (21 and 22 together) helps prevent the inadvertent unlocking and disassembly by a child.

There is no need to disassemble any parts to collapse the playyard 10. In collapsing the playyard 10, all four frame locks 19 are manually rotated approximately 180 degrees, i.e. a half-turn. This causes the upper side rails to pivot downwardly at the mid-point. The floor support rails are caused to fold upwardly merely by lifting the fabric floors 21 and 22 of the playyard (aided by the loop 28, if present), to cause the support rails to pivot at their mid-points. All four vertical corner rails are gathered together such that the resultant structure is a compact unit of vertical support rails, upper side rails and floor support rails nestled together in a parallel relationship.

The playyard 10 is foldable to a compact configuration wherein it is easily transportable from one location to another. The foldable floor assembly (21 and 22 together) provides a smooth, sturdy cushioned playing surface for the child while being foldable to a box-shape configuration for housing and transporting the collapsed playyard 10. While the invention has been described with specific reference to the drawings, other embodiments and modifications are apparent and intended to be within the scope of the claimed invention.

We claim:

1. In a foldable playyard comprising an essentially rectangular upper support formed of four pair of rods each centrally coupled by a hinge; an essentially rectangular lower support formed of four pair of rods each centrally coupled by a hinge; four vertical rails interconnecting the corners of the upper and lower supports to retain the upper and lower supports in a box-like configuration with the rods of the upper and lower supports pivotally coupled to the vertical rails to allow for pivoting the rods of the upper support and lower support between horizontal orientations when the playyard is in an unfolded condition for operation and use and vertical orientations when the playyard is in a folded condition for storage; and a unitive fabric assembly comprising four vertically disposed panels each coupled to a pair of rods of the upper support and adjacent vertical tubes, the improvement comprising:

a first lower horizontal panel stitched to the vertically disposed panels and forming a part of the unitary fabric assembly, said first panel not being coupled between the rods of the lower rectangular support; and a second lower horizontal panel coupled between the rods of the lower rectangular support but not forming a part of the unitary fabric assembly.

2. The improvement of claim 1 further including a support funnel depending downwardly from the midpoint of the second lower horizontal panel, the funnel being attached at its upper end to the underside of the second lower horizontal panel with its lower end being in contact with the floor for supporting the central portion of the playyard.

3. The improvement of claim 1 further including a removable floor peripherally positionable on the first lower horizontal panel for supporting a child when the playyard is unfolded.

4. The improvement of claim 1, wherein the second lower horizontal panel has a peripheral hem for receiving in the rails of the lower rectangular support.

5. The playyard as set forth in claim 4 wherein the lower edges of the vertical panels extend downwardly and are folded inwardly and are then stitched to the upper surface of the first horizontal panel.

* * * * *

UNITED STATES PATENT AND TRADEMARK OFFICE

CERTIFICATE OF CORRECTION

PATENT NO. : 5,581,827

DATED : December 10, 1996

INVENTOR(S) : H.G. Robert Fong and Denny T.H. Tsai

It is certified that error appears in the above-indentified patent and that said Letters Patent is hereby corrected as shown below:

Title page, item [56]

References Cited, please list "2,365,918 10/1977 German".

Signed and Sealed this

First Day of July, 1997

Bruce Lehman

*Attest:*

BRUCE LEHMAN

*Attesting Officer*

*Commissioner of Patents and Trademarks*